US007257362B2

(12) United States Patent
Facci et al.

(10) Patent No.: US 7,257,362 B2
(45) **Date of Patent: *Aug. 14, 2007**

(54) PHOTORECEPTOR ABRADER FOR LCM

(75) Inventors: John S. Facci, Webster, NY (US); William H. Wayman, Ontario, NY (US); Moritz P. Wagner, Walworth, NY (US); Paul J. McConville, Webster, NY (US); Michael J. Turan, Walworth, NY (US); Douglas A. Lundy, Webster, NY (US)

(73) Assignee: Xerox Corporation, Stamford, CT (US)

( * ) Notice: Subject to any disclaimer, the term of this patent is extended or adjusted under 35 U.S.C. 154(b) by 116 days.

This patent is subject to a terminal disclaimer.

(21) Appl. No.: 11/093,108

(22) Filed: Mar. 29, 2005

(65) Prior Publication Data

US 2006/0222425 A1 Oct. 5, 2006

(51) Int. Cl.
*G03G 21/00* (2006.01)

(52) U.S. Cl. ..... 399/347; 399/349; 399/353; 399/354

(58) Field of Classification Search ..... 399/343, 399/347, 349, 353, 354
See application file for complete search history.

(56) References Cited

U.S. PATENT DOCUMENTS 4,364,329 A * 12/1982 Murai et al. ..... 399/347
5,128,725 A * 7/1992 Frankel et al. ..... 399/347
5,652,951 A * 7/1997 Thayer et al. ..... 399/354 X
6,269,236 B1 * 7/2001 Mori et al. ..... 399/354

* cited by examiner

*Primary Examiner*—Sandra L. Brase
(74) *Attorney, Agent, or Firm*—Lloyd F. Bean, II

(57) ABSTRACT

A cleaning system for cleaning an imaging surface moving in a process direction, including: an abrading brush for uniformly abrading the imaging surface to remove laterally conductive deposits that lead to lateral charge migration therefrom, the abrading brush includes a core defining a core length and having fibers extending outwardly therefrom, the fibers include abrasive particles attached thereto.

12 Claims, 12 Drawing Sheets

FIG. 5
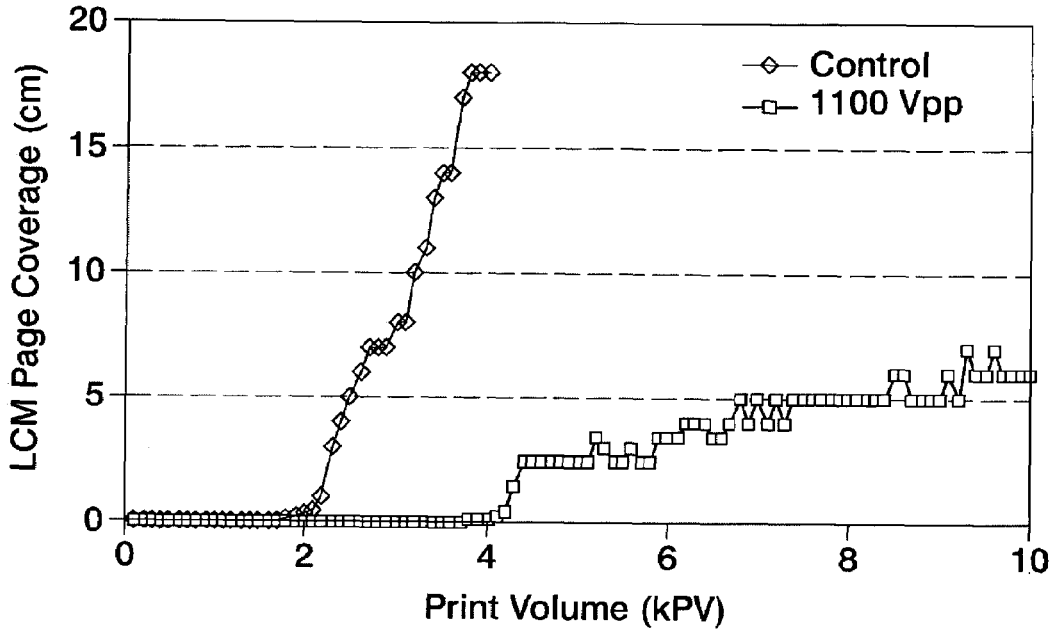
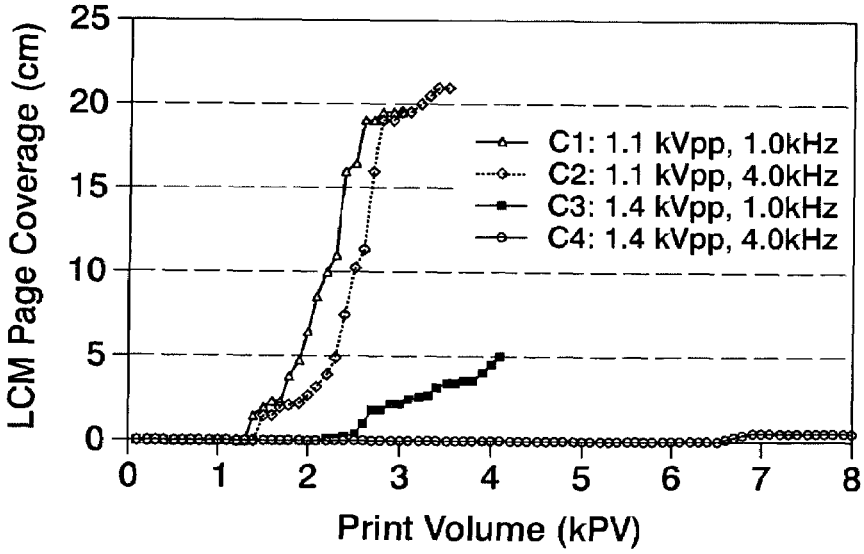
FIG. 6

FIG. 7
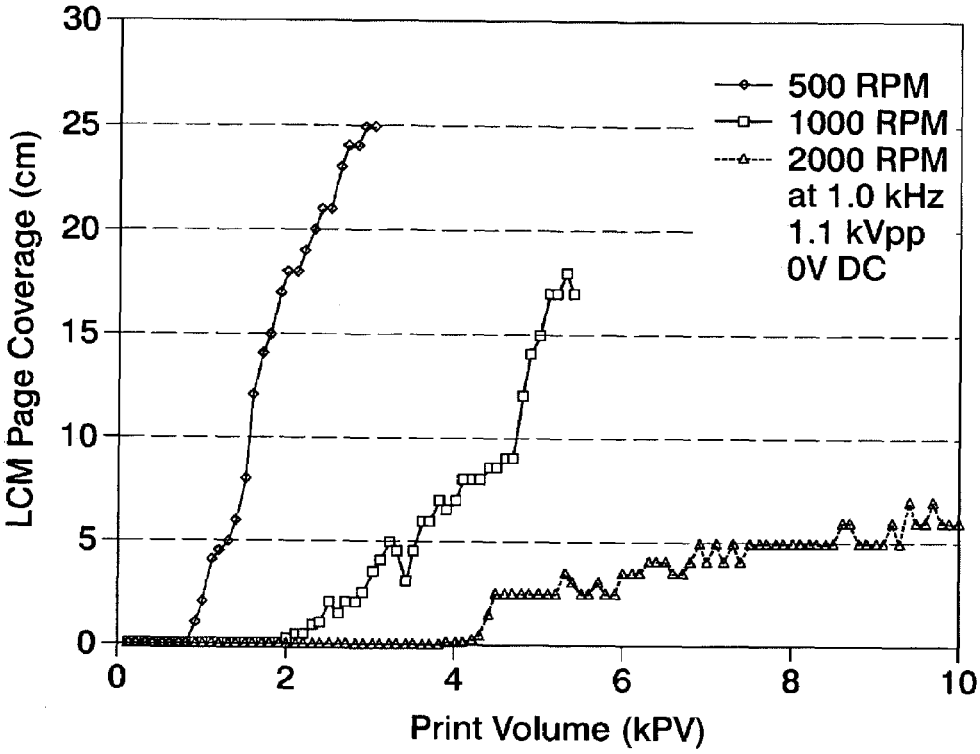
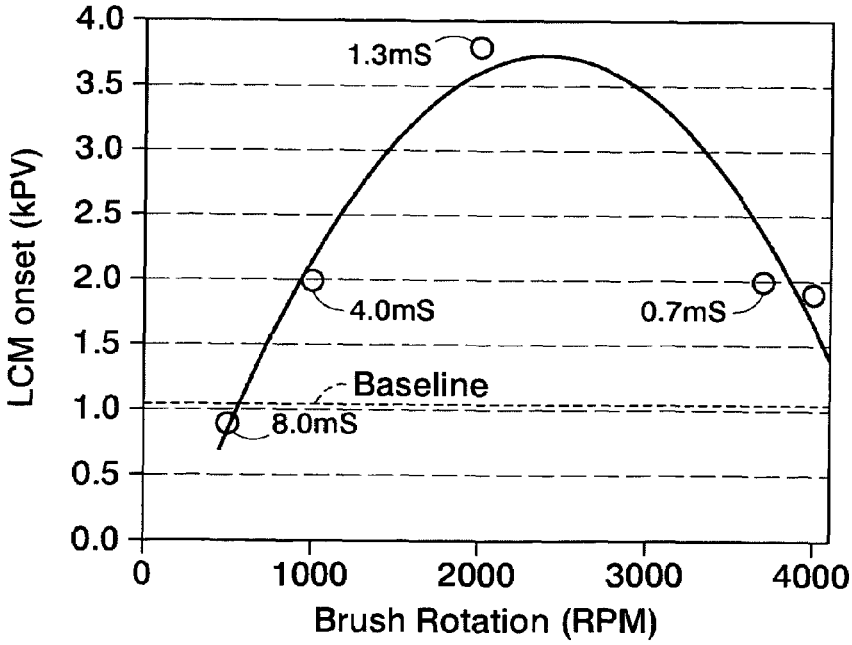
FIG. 8

FIG. 10
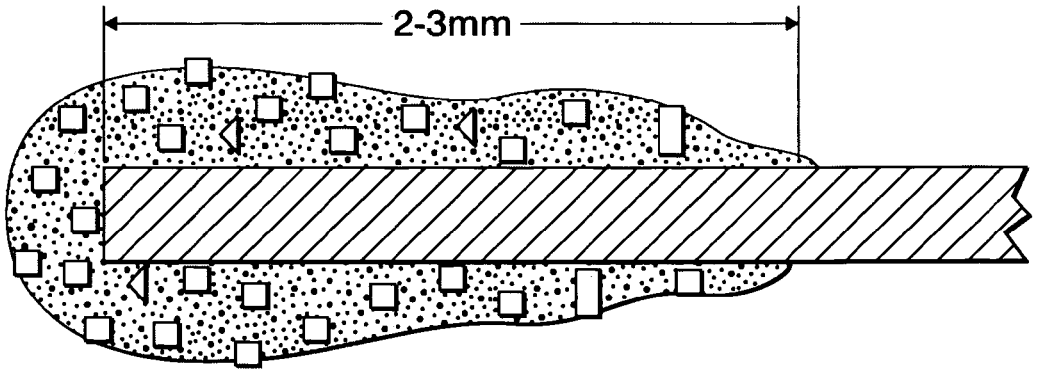
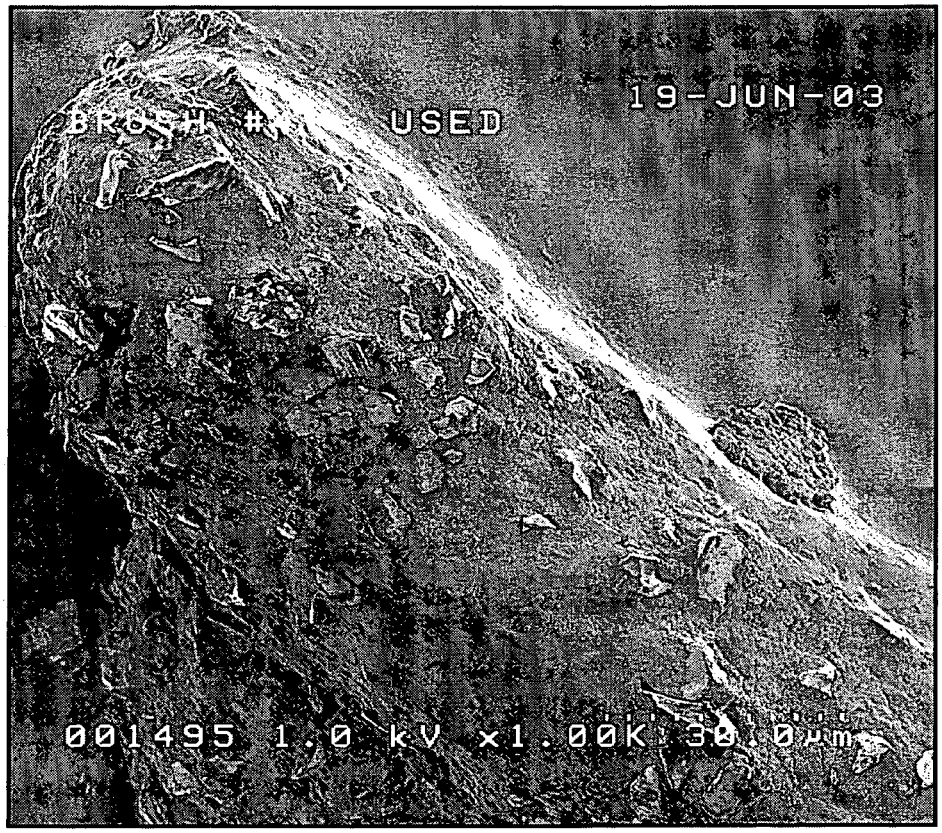
FIG. 11

| Cell # | kVpp | Frequency | LCM Onset |
|---|---|---|---|
| 1 | 1.2 | 1.0 kHz | 0.9 |
| 2 | 1.2 | 1.5 kHz | 0.8 |
| 3 | 1.63 | 1.0 kHz | 17.4 kP |
| 4 | 1.63 | 1.5 kHz | 20.0 kP |

1000 RPM, 20mm Footprint

FIG. 15
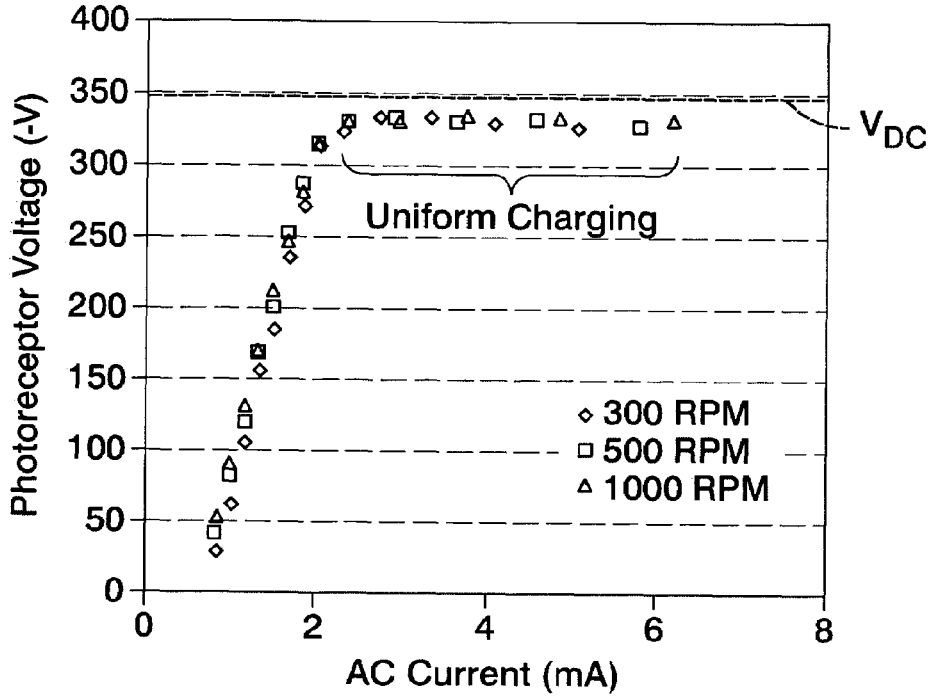
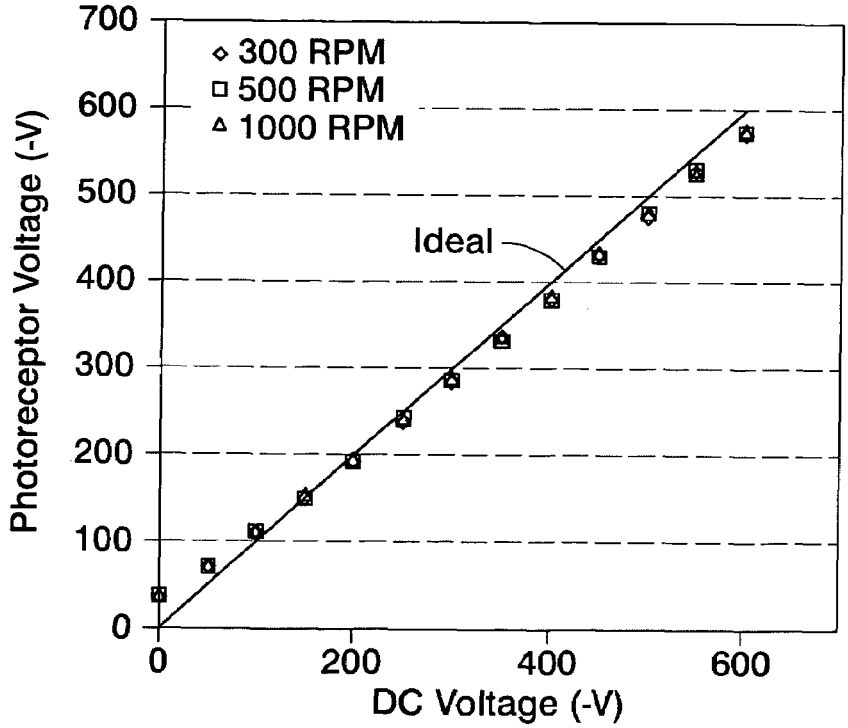
FIG. 16

FIG. 17
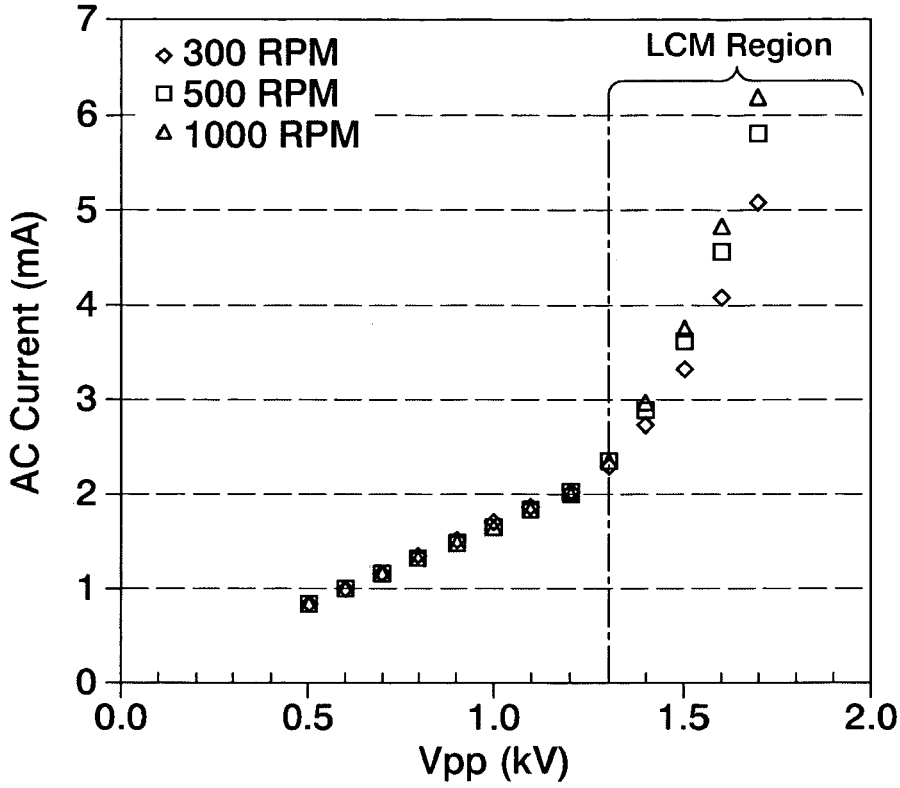
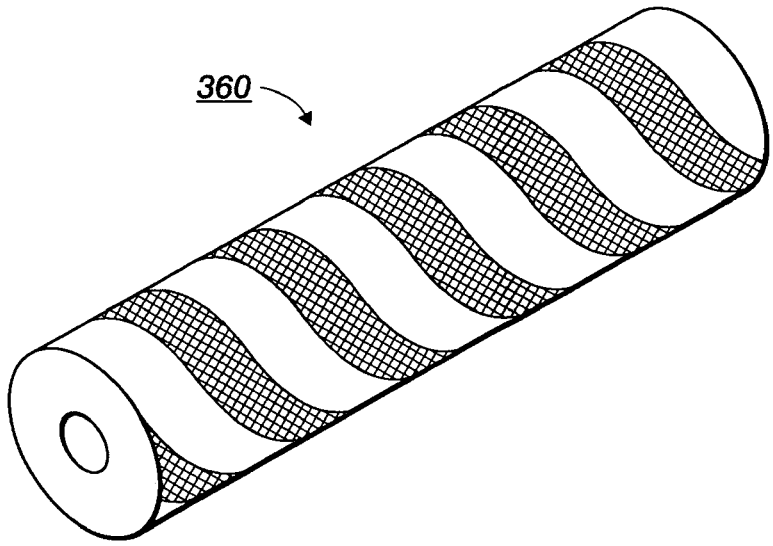
FIG. 18

PHOTORECEPTOR ABRADER FOR LCM

CROSS-REFERENCE TO RELATED APPLICATIONS

Reference is made to commonly-assigned U.S. patent application Ser. No. 11/093,110 filed Mar. 29, 2005, now U.S. Publication No. 20060222424, entitled AC BIASED CONDUCTIVE BRUSH FOR ELIMINATING VOC INDUCED LCM, by John Facci et al. and U.S. patent application Ser. No. 11/093,109, filed Mar. 29, 2005, now U.S. Publication No. 20060228486, entitled FABRICATION AND METHOD FOR MAKING AC BIASED CONDUCTIVE BRUSH FOR ELIMINATING VOC INDUCED LCM, by John Facci et al., the disclosures of which are incorporated herein.

BACKGROUND AND SUMMARY

The present invention relates to brushes, especially cleaning brushes employed in xerographic printing machines, and more particularly to a cleaner brush for removal of semi-conductive contaminants such as laterally conductive films on a photoreceptor.

In known electrostatographic reproducing apparatii, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam.

Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development, the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure. Usually, all of the developed toner does not transfer to the copy paper, and therefore cleaning of the photoreceptor surface is required prior to the point where the photoreceptor enters the next charge and expose cycle.

Commercial embodiments of the above general processor have taken various forms and in particular various techniques for cleaning the photoreceptor have been used such as a rotary cleaning brush. Generally the bristles of such a cleaner brush are soft so that as the brush is rotated in contact with the photoconductive surface to be cleaned, the fibers continually wipe across the photoconductive surface to produce the desired cleaning without significant wear or abrasion to the photoreceptor.

A problem associated with cleaner brush is the removal of laterally conductive salt deposits on the photoreceptor. The problem is more acute in printing machines employing the image on image (IOI) process in which a relatively gentle non-interactive development system and a brush cleaner system is used. The result is that over time the belt surface becomes increasingly contaminated, leading to image degradation and visualization of interdocument zone features in jobs with mixed media sizes. Applicants have found that Lateral Charge Migration (LCM) manifests itself when abrasion or wear of the photoreceptor is insufficient to remove semi-conductive species that accumulate at the photoreceptor surface as a result of photoreceptor interactions with corona emissions and/or volatile organic contaminants.

Subsequent developments in cleaning techniques and apparatii, in addition to relying on the physical contacting of the surface to be cleaned to remove the toner particles, also rely on establishing electrostatic fields by electrically biasing one or more members of the cleaning system to establish a field between a conductive brush and the insulative imaging surface so that the toner on the imaging surface is attracted to the brush by electrostatic forces. Thus, if the toner on the photoreceptor is positively charged then the bias on the brush would be negative. Therefore, the creation of a sufficient electrostatic field between the brush and imaging surface to achieve the desired cleaning effect is accomplished by applying a DC voltage to the brush.

There has been provided a cleaning system for cleaning an imaging surface moving in a process direction, comprising: an abrading brush for uniformly abrading the imaging surface to remove semi-conductive deposits that lead to LCM therefrom, said abrading brush includes a core defining a core length and having fibers extending outwardly therefrom, said fibers include abrasive particles attached to the end of said fibers.

There has also been provided an electrostatic printing machine having a cleaning system for cleaning an imaging surface moving in a process direction, comprising: an abrading brush for uniformly abrading the imaging surface to remove semi-conductive deposits that lead to LCM therefrom, said abrading brush includes a core defining a core length and having fibers extending outwardly therefrom, said fibers include abrasive particles attached to the end of said fibers.

BRIEF DESCRIPTION OF THE DRAWINGS

FIGS. 5-8 are experimental data of using an embodiment of the invention on a photoreceptor.

FIG. 10 illustrates a schematic of an abrasive coated fiber.

FIG. 11 illustrates a micrograph of a fiber tip.

FIGS. 15-17 are experimental data of using an embodiment of the invention on a photoreceptor.

FIG. 18 is an alternative embodiment of the cleaning station.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
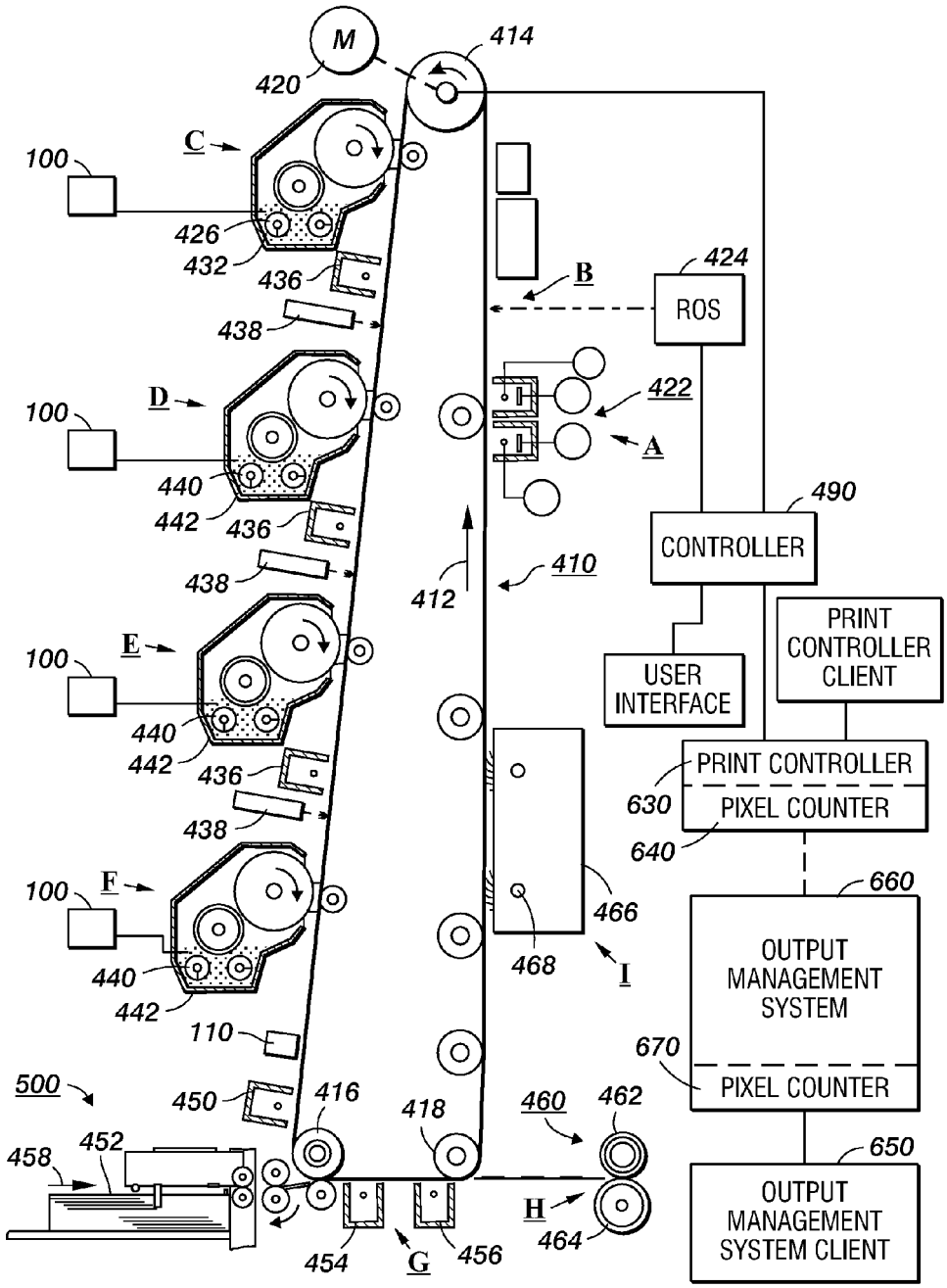
FIG. 1 is a schematic elevational view of a typical electrophotographic printing machine.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the toner control apparatus of the present invention may be employed in a wide variety of devices and is not specifically limited in its application to the particular embodiment depicted herein.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 200 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

Figure 2:
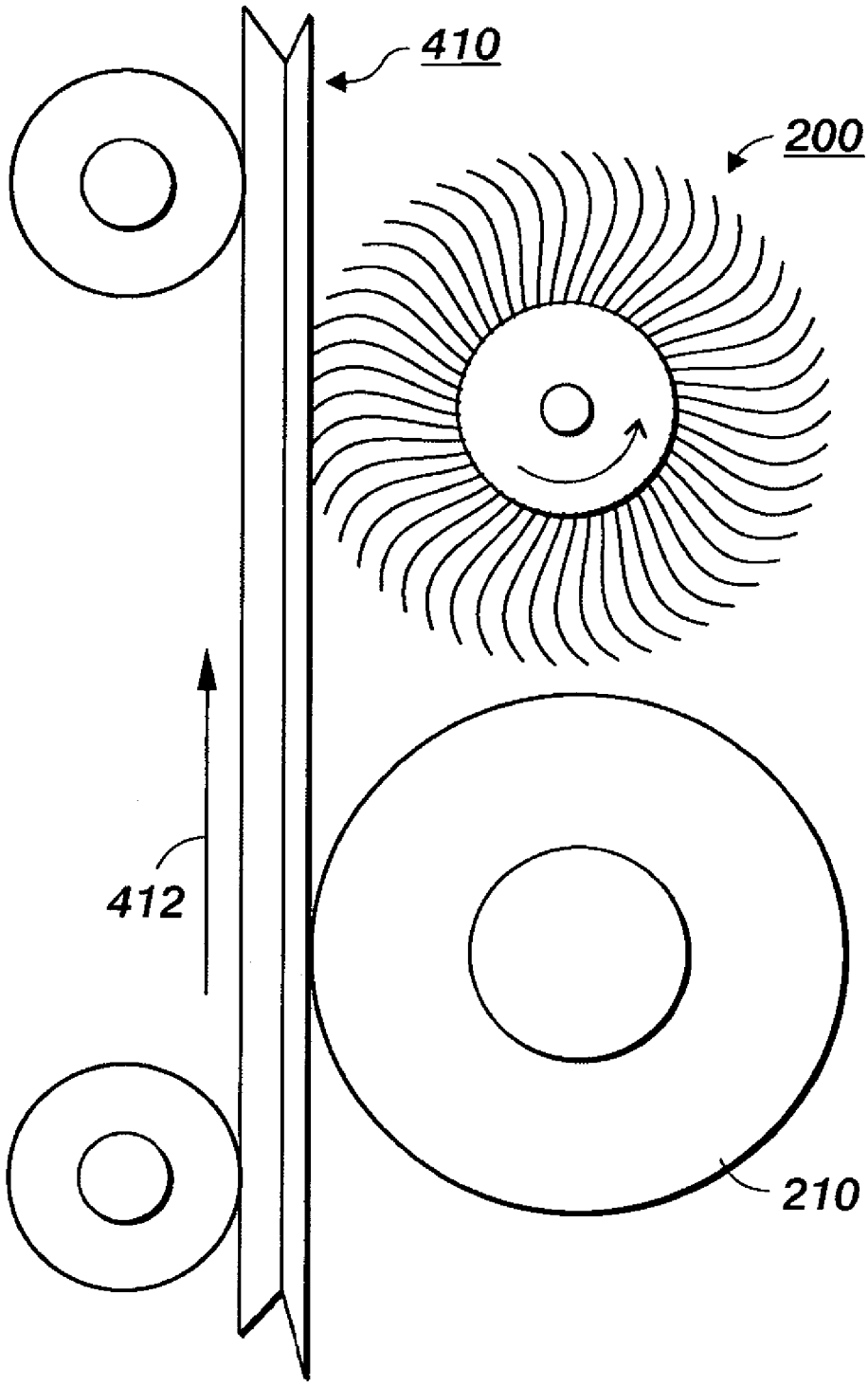
FIG. 2 is a schematic elevational view of an embodiment of a cleaning station.

Now focusing on an embodiment of cleaning station I illustrated in FIG. 2. Cleaning station I includes a primary cleaner member 210 such as, for example, an elongate cleaning blade or brush which removes the majority of residual toner particles from photoreceptor 410. The primary cleaner member 210 is urged against photoreceptor 410 with a force sufficient to remove toner particles from the photoreceptor.

Adjacent to primary cleaner member 210 rotating abrading brush 200 extends across the photoreceptor 410 so as to make contact with substantially the entire width of photoreceptor 410; located downstream of primary cleaner member 200 with respect to process direction 412. Brush 200 includes a plurality of fibers having a hardness which is greater than a hardness of the charge retentive surface so that the fibers will scratch the charge retentive surface when contacted therewith to remove conductive species that accumulate at the photoreceptor surface as a result of photoreceptor interactions with corona effluents. Preferably the fiber end tip is coated with abrasive particles to achieve the desired removal affects.

During extensive research, Applicants have found that Lateral Charge Migration (LCM) manifests itself in xerographic systems when insufficient photoreceptor wear or abrasion (<5-10 nm/kcycle) exists to remove conductive species that accumulate at the photoreceptor surface as a result of photoreceptor interactions with corona effluents and/or volatile organic contaminants. The deposited conductive species are typically nitrate salts. In most cases the photoreceptor wear rate achieved in xerographic systems incorporating both two-component development and employing a primary cleaner having a blade cleaning subsystems, typically 25-40 nm/kcycle, is sufficient to prevent LCM.

On the other hand, the IOI process incorporates as illustrated in the printing machine of FIG. 1 relatively gentle non-interactive development employing a primary cleaner having a brush cleaning subsystem. Consequently, in printing machine of the type of FIG. 1, photoreceptor wear rate has been found to be rather low, ~9 nm/cycle. Over time the belt surface becomes increasingly contaminated with laterally conductive salt deposits, leading to degradation of image quality. The latter image quality defects are related to image content. The LCM defect in a detecting print corresponds to background or untoned areas of the generating print. Conversely, toned areas of the generating print do not manifest the LCM defect in the detecting print. This becomes an issue for print jobs that mix media sizes or when switching from a job of one media size to another as the interdocument zone (IDZ) patches becomes evident. For example, after switching from a 10 pitch to a 5 pitch job, the 10-pitch IDZ patches (which are toned) show a normal appearance in the corresponding area of the 5 pitch job while the no-patch areas of the IDZ lead to LCM'ed areas of the 5 pitch job.

Secondly, Applicants have found that the problem in IOI process machines is compounded by the presence of a zinc stearate film which appears to be a key initiator of LCM. Volatile Organic Contaminants (VOCs) such as airborne amines (morpholine, ammonia, etc.) and corona effluents such as nitric oxide and its byproducts (NOx) interact preferentially with Zn stearate. Essentially the stearate film provides a locus for the adsorption of morpholine and ammonia; the latter amine species demonstrably do not adsorb or adhere only weakly at a bare photoreceptor surface. NOx and its ultimate by-product nitric acid also accumulate in the stearate film. Acid-base reaction between nitric acid and the amine lead to incorporation within the stearate film of morpholinium or ammonium nitrate salts, which are laterally conductive. Other as yet undiscovered VOC/film interactions may also be present. Because the mechanism of LCM involves the confluence of several factors including the presence of VOCs, the latter is referred to as VOC induced LCM. In summary, one of the main issues is that the conductive species are deposited within or underneath the stearate contamination on the photoreceptor. Zinc stearate filming of the photoreceptor renders removal of the laterally conductive species difficult either by covering the laterally conductive species or by tenaciously harboring them on the photoreceptor surface.

EXAMPLE 1

Applicants have tested an abrasive cleaner brush for removal of the laterally conductive salt deposits. The abrasive cleaner brush employed in the test was fabricated based on the IGEN3® cleaner brush configuration [SA-7 acrylic fiber, 10 denier per fiber, 60K fibers/in2, 16.5 mm pile height]. The modified cleaner brush consists of fibers that are coated with SiC abrasive particles bound in an epoxy or KRYLON® ultra flat black spray paint as the binder. The fibers were coated with a ball-milled mixture of DP90 (an automotive epoxy primer made by PPG) and 1000-grit silicon carbide powder. The experimental brushes were spray coated with 2 spray passes and allowed to air dry for 12 hours. Half the brushes were coated with the binder only (which contained silica as a flattening agent and carbon black for color) and the other half was coated with the addition of 1000-grit abrasive. A small section was left completely uncoated. The brushes were then oven dried at 150° F. for 24 hours to ensure a full cure of the epoxy binder. Scanning electron micrographic analyses clearly show SiC particles protruding from the binder material. The depth of penetration of the abrasive coating into the brush nap is estimated to be around 1-2 mm. The modified brushes were tested by replacing the wrong sign toner brush (upper brush) in the cleaner assembly with the abrasive brush in an IGEN3® printer. Testing is done at the normal process conditions, i.e. 300 rpm rotation counter to the photoreceptor, −290 V applied to the brush core, and no intentional change to the brush interference. All testing is done in lab ambient and in simplex printing mode to avoid issues with direct oil contamination of the photoreceptor or the brushes.

In the evaluating the effectiveness of the cleaning brushes, Applicants have developed an accelerated LCM test based on introduction into the xerographic cavity of morpholine. The latter was selected because it is the stress case for VOC induced LCM; the threshold concentration for LCM onset is only 2-3 ppb morpholine. During accelerated testing, 75±10 ppb morpholine vapor (as measured by Tenax tube sampling) is introduced into the xerographic cavity via the return hose of the environmental unit. The xerographic cavity is bathed in morpholine vapor for 20 minutes before start of print to ensure a steady state concentration throughout the cavity. A running target that includes toned and background areas of each color is run for 90 prints followed by 10 magenta zip tone targets of 4 pixels on/4 pixels off. The latter analytical target is especially sensitive for the detection of LCM. Note that the zip tone lines run cross process direction. The set of 90 running and 10 analytical targets are repeated until evidence of LCM is detected.

It was observed that the lateral charge migration was manifested by line broadening in the 4-on/4-off print target. The LCM signature infallibly starts at a position about ⅔ of the way inboard due to charger airflow configuration and other airflow patterns in the vicinity of the PR. The onset of LCM manifests itself as a nearly continuous narrow band in the process direction, i.e., where the zip tone initially broadens. Control belts exposed to 75 ppb morpholine in a machine in lab ambient, indicate an LCM onset between 1000 and 1200 prints in our accelerated testing.

Figure 3:
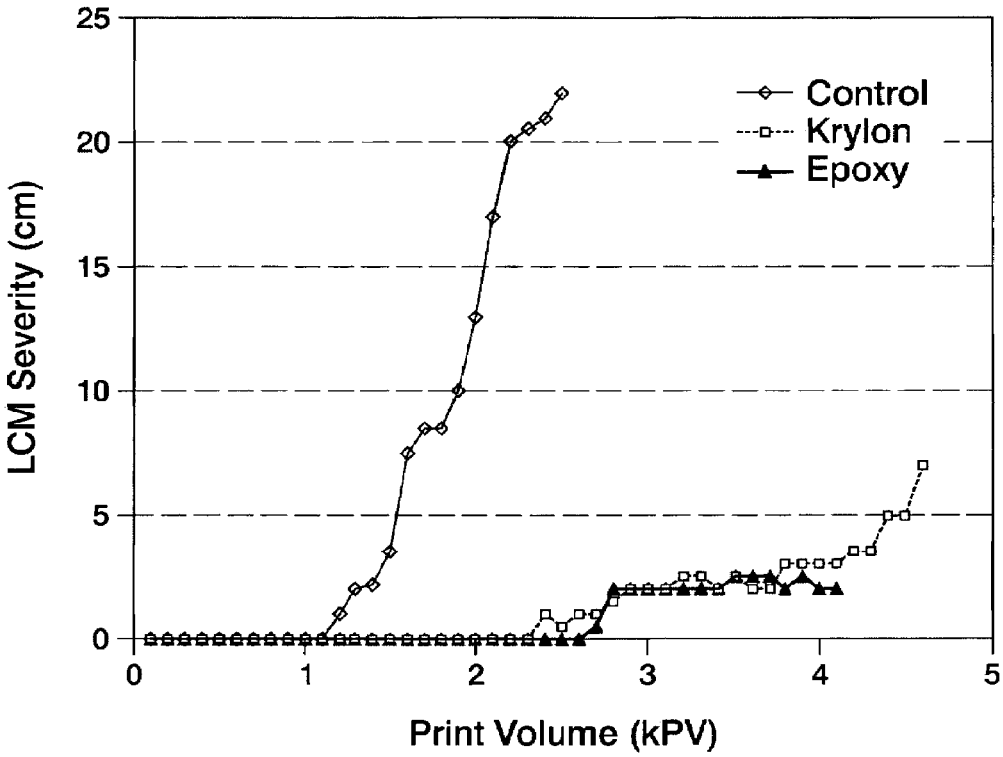
FIG. 3 is experimental data of using an embodiment of the invention on a photoreceptor.

As LCM becomes more severe it spreads both inboard and outboard over the page from the initial position until the page becomes substantially covered by the defect. A visualization of the increasing severity of LCM. A semi-quantitative measure of LCM severity is therefore the width in the cross process direction over which the LCM defects occurs. FIG. 3 plots the increase in LCM severity over time for a control photoreceptor belt.

Figure 4:
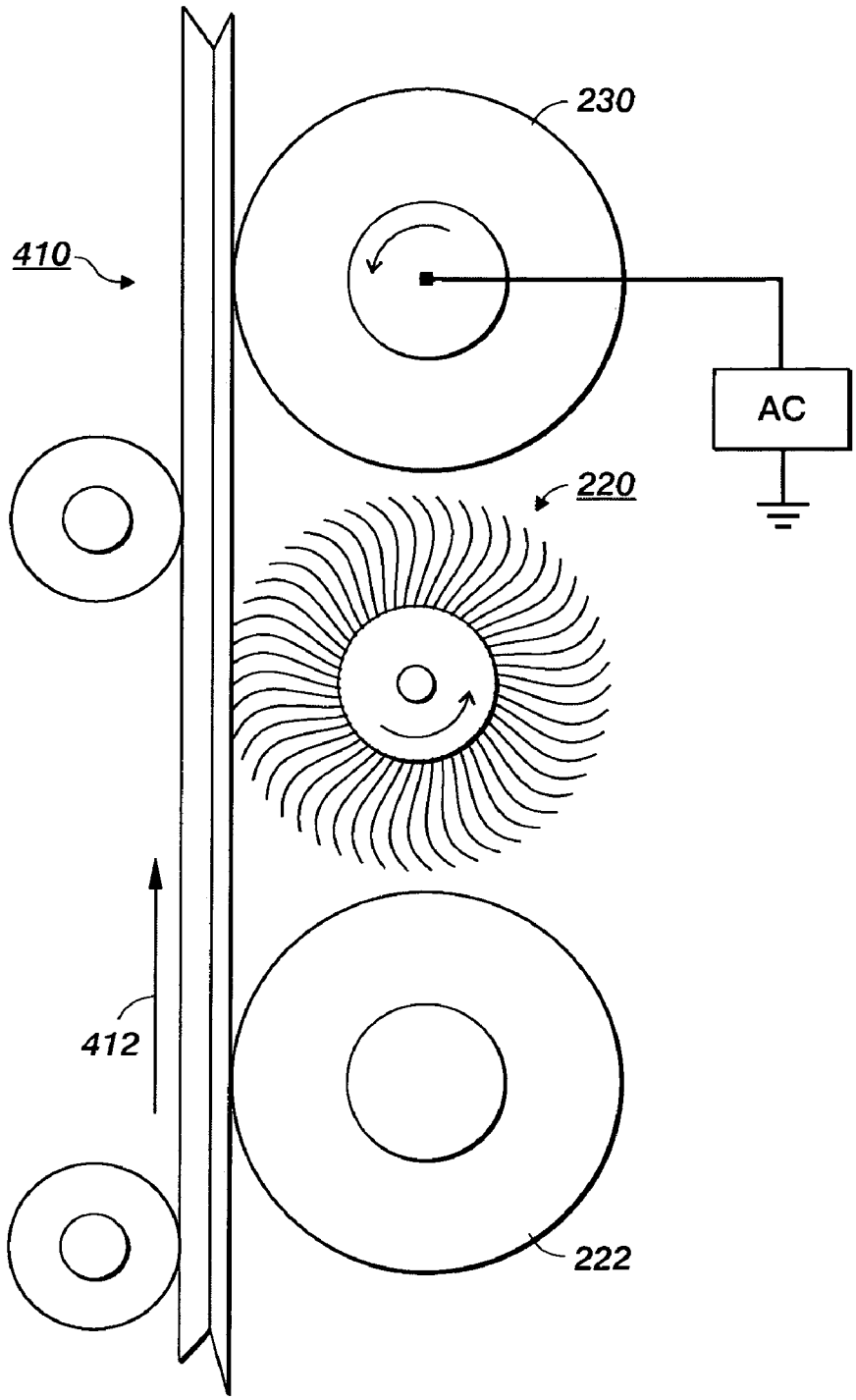
FIG. 4 is an alternative embodiment of the cleaning station.

One of the key metrics of the effectiveness of an abrasion option under test is given by the ratio of LCM onset with the abrader to that without the abrader (the control). LCM onset of two test brushes where the SiC abrasive is adhered by KRYLON® and Epoxy, is shown by FIG. 3 by the open squares and filled triangles respectively. LCM onset of the KRYLON® and Epoxy brushes are 2.4K and 2.7K prints, respectively, an improvement of >2×. The KRYLON® bound SiC brush ultimately fails as a result of loss of abrasive from the fibers leading to an increase in LCM severity near 4.5K prints. Post-mortem visual examination of the brush shows as expected that most of the abrasive grit is gone after a few thousand prints. A more robust means of attaching abrasive to the fibers is needed. The abrasive brush using the epoxy binder shows as expected a substantial improvement in terms of abrasive adhesion to the fiber. After testing a total of 12-14K prints most of the abrasive remains on the brush and LCM severity did not increase over the duration of the test as indicated in FIG. 4.

An indication of the robustness of the epoxy coated brush approach involves examination of LCM after stopping the print process. This allows the belt to bathe in the VOCs for several minutes without the benefit of abrasion and allows morpholine to absorb into or interact with any trace of stearate film that may remain on the belt and react with the nitric acid therein. Printing was stopped twice near 1500 prints. The control area of the brush that was not coated with SiC abrasive or binder showed as expected LCM immediately upon print restart. The section of the brush coated only with the epoxy binder showed LCM defects within an additional hundred prints, again as expected. Only the SiC section of the brush showed no sign of LCM defect suggesting that the Zn stearate layer and any conductive species on the surface have been removed. Printing was stopped again near 2700 prints. While LCM was severe in the non-abrasive parts of the brush, only the first hints of LCM were detected in the abrasive coated fiber section of the cleaner brush, and this in the area of photoreceptor that typically exhibits the most severe LCM. It is evident that additional optimization of belt wrap and rotational velocity, coating process could improve the effectiveness even further.

An additional benefit of the epoxy coated brush is that electrically insulating Zn stearate apparently is not allowed to accumulate on the photoreceptor and therefore a positive Zn stearate "ghost" of the running target is never observed in the analytical target. So far printable streaks due to photoreceptor abrasion and photoreceptor filming have not been observed.

It will be recognized that other variations are possible in fabrication of the abraded brush. The abrasive brush can be canted by a few degrees so that scratch marks on the photoreceptor will be offset slightly from the process direction. This should increase the abrasion uniformity. Increasing the photoreceptor wrap about the brush could also increase effectiveness by increasing the number of fiber strikes on the photoreceptor. In related brush tests, wrap was shown to be a major driver of performance. Finally the fibers tip themselves or the entire length of the fiber may be filled with abrasive particles. As the binder wears away more abrasive would be exposed.

In a second embodiment Cleaning Station as illustrated in FIG. 4 includes primary cleaner 222, an abrasive brush 220, and AC biased brush roller 230 in combination to eliminate VOC induced LCM. In this embodiment abrading is the same configuration as the first embodiment.

EXAMPLE 2

Features of this embodiment was also tested in an IGEN3® printer: a special brush mount in the machine downstream of the cleaner subsystem (auxiliary position) allowed us to vary most of the parameters. The mount has the capability of adjusting the position of the brush both perpendicular and parallel to the photoreceptor so that brush interference (footprint on photoreceptor) and position along the photoreceptor (photoreceptor wrap) can be adjusted. An externally controlled DC motor is also mounted to vary brush speed. Tests were done with the brush rotating counter to the photoreceptor rotation. The brush is electrically isolated and conventional Trek amplifiers were used to supply high voltage AC to the brush.

The IGEN® cleaner brush used in these tests is composed of 10 denier per fiber SA-7 acrylic fibers. Brush density is 60 kfibers/in$^2$. The pile height is 16.5 mm and the overall diameter of the brush is 63 mm. The peripheral speed of the brush running in the cleaner housing at 300 RPM is almost 1 m/sec. Running the AC biased brush in the cleaner housing at the normal brush speed of 300 RPM was not found to be effective because of the low brush speed and insufficient number of fiber strikes on the photoreceptor. FIG. 5 shows LCM onset and page coverage with time of a nominal IGEN® cleaner brush mounted in the auxiliary position with and without AC bias applied to the brush. Brush speed is 2000 RPM, AC frequency is 1.0 kHz, Vpp=1.1 kV and the DC offset VDC=0V. Brush footprint was approximately 13 mm. (Cleaner brushes in the cleaner housing are run "as is.") The open diamonds curve presents the control data: without applied AC bias, LCM onset is extended 2× from the no-brush case due the mechanical abrasion action of the additional rotating brush. However LCM severity progresses rapidly as shown by the high slope of the curve. The open squares curve shows the result of applying the AC bias. LCM onset is extended 2× over no AC bias and 4× over the control with no countermeasure. Also the progression of LCM is less rapid as shown by the lower slope of the latter curve. Applicants hypothesize that application of the AC bias has two effects: 1) plasma etching of the surface similar to the AC effect commonly observed during bias roll charging, and an increase in the mechanical abrasion from increased electrostatic attraction of the fibers to the photoreceptor. Evidence for this comes from comparison during rotation of the brush shape with the AC turned on and off. The increased electrostatic attraction can be thought of as an electrostatic stiffening of the brush.

Applicants have also found that increasing the brush footprint or brush/photoreceptor nip width delays the LCM onset and decreases the rate of page coverage by LCM. FIG. 6 shows the results of a 2×2 classical design of experiments (DOE) study of frequency and Vpp at 2000 RPM. Interference was fixed during the test but reduced from that represented in FIG. 1. Data analysis shows that Vpp is a key driver and that frequency interacts strongly with Vpp. Due to this interaction, higher Vpp needs to be accompanied by higher frequency to minimize LCM defects. Note that at both high frequency and Vpp an effectiveness enhancement of 6-7× is obtained. This represents a high level of effectiveness. An additional key result is that LCM in the interdocument zone which is usually severe, is very significantly improved. Note that even after LCM onset the page coverage remains small as shown in FIG. 6. A factor of 10× in the accelerated test corresponds to LCM life of 300 kP.

FIG. 7 shows the effect of brush rotational velocity on LCM. The curves present LCM behavior at 500, 1000 and 2000 RPM. Conditions are as follows: F=1.0 kHz, Vpp=1.1 kV, VDC=0 V. Note that LCM onset improves with brush rotational velocity implicating the importance of the number of fiber strikes. In addition as rotational velocity increases the rate of increase of page coverage with the defect tends to decrease. FIG. 8 plots LCM onset values as a function of brush rotational velocity from 500 to 4000 RPM. Note the inverted parabola trend. The number in parentheses overlaid near each data point is the calculated contact time of an individual fiber with the PR surface. The reason for the decreasing effectiveness at the highest brush speed is that the fiber dwell time on the PR is less than the period of a full AC cycle at 1 kHz. Note that the fibers will not corona discharge when the bias on the brush passes through 0V. Thus the average amount of time that the contacting brush fibers are corona emitting decreases as the rotational velocity increases. Increasing frequency is therefore required as brush rotational velocity increases.

Visual analyses of the belts from the above tests indicate a normal level of photoreceptor scratching, nothing beyond that which we typically observe without the AC biased brush. In addition, image quality is not noticeably degraded by the level of scratching on the photoreceptor.

Parameters which may also be modified include brush pile height, brush density and material, and photoreceptor wrap. For example nylon is known to be more abrasive than acrylic. Increasing the brush weave density would increase the number of fiber strikes and improve effectiveness. Increasing the photoreceptor wrap, which was found to be beneficial in other brush tests, should also enhance effectiveness. The concept can be extended to canting the brush slightly so that the fibers do not follow the same track on the photoreceptor. Optimization of all the parameters together should allow further improvement in LCM fix effectivity.

One of the main advantages of this concept is that it uses the current IGEN3® cleaner brush. It is contemplated that the brush may be operated in the 2nd cleaner brush position with modifications to the current power supply and motor speed—the 1st and 2nd cleaner brushes could be coupled to the same motor but with different drive ratios. In order to accommodate the cleaning requirements, the AC bias would have to be DC offset. The offset would be approximately equal to the applied DC bias in the current 2nd cleaner brush configuration. This ensures that a non-zero average bias exists on the brush so as to clean toner from the photoreceptor. The DC offset would be approximately −300V; as a result the photoreceptor would become charged to approximately −250 V. This voltage would either be erased by a conditioning lamp or managed by the first charge/recharge station. Alternatively, the 2nd cleaner brush could be operated as in the current IGEN3® configuration except that an abrasion cycle could be initiated as needed, for example in the case of non-severe LCM, or LCM associated with limited VOC releases at the customer site, or as a touch up at day start, cycle up, cycle out, fuser warm up, etc. In this case we envision a change in motor speed and change in electrical bias from the normal cleaner conditions to optimized abrasion conditions.

Alternatively, the AC biased brush could be provided a position of its own outside the cleaning housing similar to the testing conditions described above. Although it requires more room this would have the least impact on the rest of the system.

The concept is not limited to AC biases. A negative DC bias that generates corona may also be suitable with the advantage that a relatively inexpensive DC power supply would be sufficient. A DC voltage would be approximately −900V to −1000 V exhibits a fix effectivity of 2× in accelerated testing.

Figure 9:
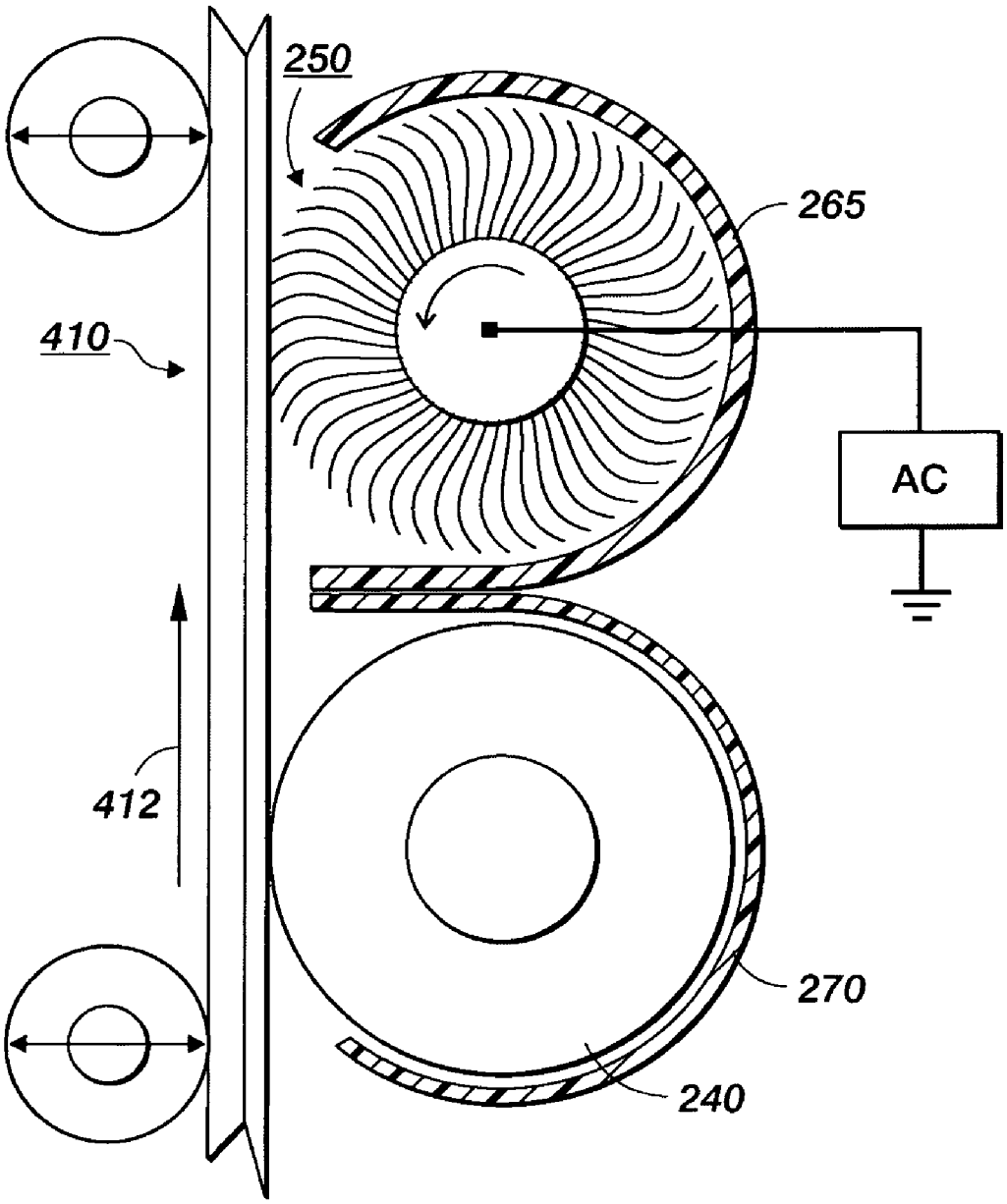
FIG. 9 is an alternative embodiment of the cleaning station.

In a third embodiment of cleaning Station I as illustrated in FIG. 9 includes primary cleaner 240, an AC biased abrasive brush 250 for eliminating VOC induced LCM Print Defects. Applicants have found that AC abrasive brush combines the needed functions of molecular degradation by the AC corona and scrubbing/abrading action of the abrasive fibers. Brush 250 is enclosed in housing 265 and primary cleaner 240 also has a separate housing 270. Conductive and insulating synthetic fibers based on styrene-acrylate, acrylic, nylon, polyethylene, polypropylene, polyester, polystyrene, rayon, polyethylethylketone (PEEK), polyvinylchloride, Teflon, carbon fiber and natural fibers including tampico, horsehair, palmetto, and palmyra, that are between approximately 1 denier per fiber and 30 denier per fiber in diameter and between 1 mm and 20 mm in length may be used. Abrasive particles consisting of silicon carbide, aluminum oxide, cerium oxide, iron oxide, cubic boron nitride, garnet, silica, glass, zirconia, diamond and the like may be used.

EXAMPLE 3

The principle of this third embodiment was tested wherein the Brush fabricated by employing 37.3 g of epoxy DP90LF are added 19.9 g of DP402LF accelerator. To this is added 24.4 g of lacquer thinner and finally 10.6 g of 1000 grit SiC. Shot is added to the mixture to assist with dispersion. The mixture is sprayed onto standard IGEN3® cleaner brushes at ~30 psi. The brushes are then briefly air dried and finally cured overnight at 150° F. in a convection oven. The IGEN3® cleaner brushes are composed of 10 denier per fiber SA-7 acrylic fibers with a brush density of 60 kfibers/$in^2$, pile height of 16.5 mm and the overall diameter of 63 mm.

FIG. 10 shows a schematic of an abrasive coated fiber. Typically 2-3 mm of the fiber tips are overcoated with epoxy/silicon carbide (SiC) abrasive. The abrasive coating density is fairly low, 1.5-3 $mg/cm^2$ of projected brush surface area. The abrasive coated area has a gray appearance compared with the black uncoated fibers. FIG. 11 shows a scanning electron micrograph of a fiber tip after 12K print usage, revealing tightly adhering but exposed SiC grit. Initial tests show that the 1000 grit SiC brushes are still functional at 100K prints. Photoreceptor thickness measurements indicate that photoreceptor wear due the abrasive brush is very low.

FIG. 9 shows a schematic of the implementation of the concept in an iGen3 machine. The AC abrasive brushes are located in an auxiliary or $3^{rd}$ brush housing in the machine just downstream of the cleaner subsystem separate from the cleaner housing so as not to interfere with the photoreceptor cleaning function. The brush is located 1-2 cm from a back up roll to increase the photoreceptor wrap. Brush speed, footprint on photoreceptor, photoreceptor wrap and AC parameters are all independently adjustable. The direction of brush rotation is counter to the photoreceptor and brush footprint on the photoreceptor was fixed at an optimum 18-20 mm. The brushes in the cleaner housing are of nominal materials and configuration and operating at nominal set points.

Figures 12, 13:
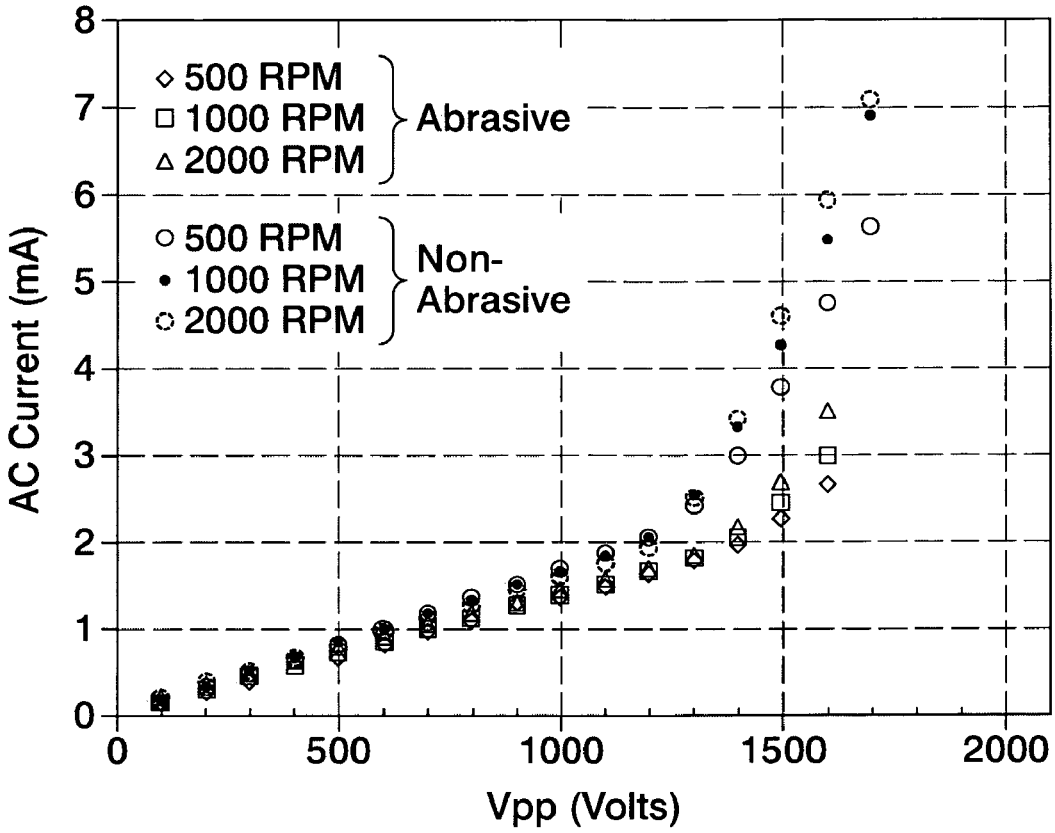
FIGS. 12 and 13 are experimental data of using an embodiment of the invention on a photoreceptor.

FIG. 12 shows a plot of the AC current-voltage characteristics of the abrasive brush compared with an unmodified brush parametric in brush rotation speed. All measurements were taken at 1.0 kHz AC. At low peak to peak voltages (Vpp) both brushes are characterized by a linear capacitive response. At higher Vpp, AC current increases rapidly due to the generation of corona discharge. Analysis indicates the corona threshold for abrasive and non-abrasive brushes is 1.4 kVpp and 1.2 kVpp, respectively, a relatively small difference. At the conditions under test for LCM, namely 1.63 kVpp, the corona discharge is easily visualized in the machine at both the entrance and exit nips of the brush.

FIG. 13 presents a table of the effectiveness of the AC abrasive brush at various AC frequencies and amplitudes in the course of accelerated LCM testing. Little or no effectiveness is obtained in cells 1 and 2 where Vpp is less than the corona generation threshold, despite abrasion from the brush. Application of Vpp greater than corona generation threshold—cells 3 and 4 in the table—leads to dramatically greater effectiveness against LCM. At 1.63 kVpp and 1.5 kHz, LCM onset in accelerated testing is not observed in 20 kP at which point the test was suspended. These results suggest that the rate of removal of the conductive layer (likely composed of a ZnSt film with incorporated or buried salts) is at least 20× greater than the rate of conductive layer build up. One of the main advantages of the single brush approach is that it is based on a simple modification of existing IGEN3® cleaner brushes which can substantially shorten development time.

It should be evident that the brush could employ: finer grit sizes with optimized binder loadings; other commonly used abrasive particles may be incorporated, such as aluminum oxide, cerium oxide, garnet, etc. Tough binders other than epoxy may be used. Carbon filler may be added to the epoxy binder during fabrication to impart additional conductivity. Fibers other than acrylic may be used, e.g. nylon. Stiffer crimped fibers may be abrasive coated to impart greater abrasiveness; fibers of non-circular cross-section may be abrasive coated, such as square, rectangular or star shaped. The length of the coated area of the fibers may be increased from the current 2-3 mm up to and including the entire fiber length; and further the brush may canted a few degrees from the process direction or rotated with the photoreceptor.

Figure 14:
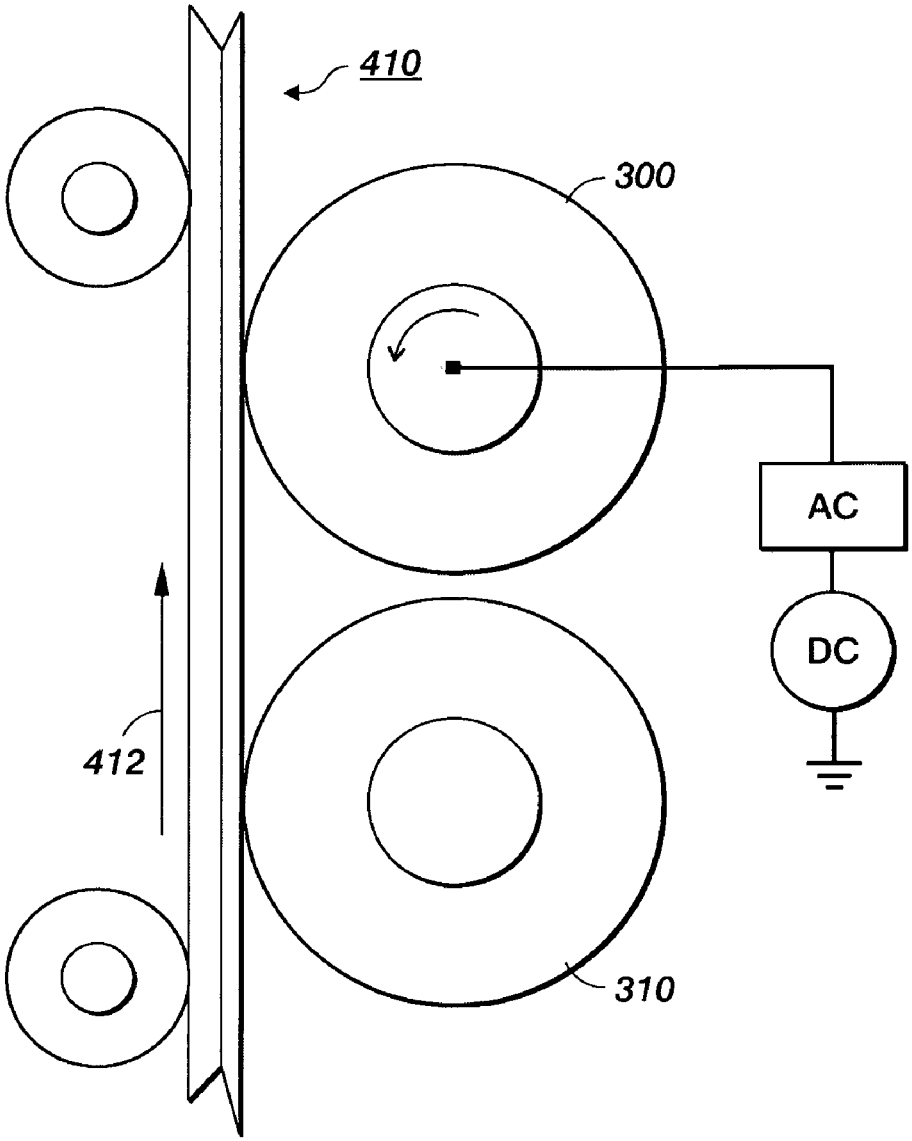
FIG. 14 is an alternative embodiment of the cleaning station.

A fourth embodiment of cleaning Station I as illustrated in FIG. 14 includes a primary cleaner 310 and an abrasive biasable photoreceptor cleaner brush 300 for eliminating LCM of the third embodiment combined with applying a DC offset AC bias to our previously developed AC abrasive brushes. This allows the latter to be used in the cleaner subsystem effectively as both an LCM countermeasure and as a photoreceptor cleaner.

EXAMPLE 4

Applicants have found that the DC offset AC biased abrasive brush meets the goal of 10× life extension in accelerated LCM tests. The AC frequency is set high enough (1-4 kHz) so that the toner does not respond to the individual AC cycles but rather responds only the average or DC bias. Testing to 150 kP has shown no adverse effects on photoreceptor cleaning at 150 kprints. No residual toner is found on the brush on cycle out or after a hard stop and the brush abrasive layer is in excellent condition. Photoreceptor scratching at 150 kP is also normal for a photoreceptor of this age.

The abrasive brush is installed in the second cleaner housing. The second cleaner has to deal with about 10% of the residual toner which is wrong sign. Leaving the 1st cleaner "as is" minimizes perturbation of the cleaner function since the first brush does most of the cleaning (of right sign toner).

In normal machine operation a DC bias of −300V to −400V is applied to the second cleaner brush to clean wrong sign toner from the PR surface. With AC superimposed on DC an average negative DC bias must be maintained to achieve wrong sign toner cleaning. We have found that a DC offset of −350V is suitable. A large amplitude 1-4 kHz AC bias is superimposed on the DC bias to generate the AC corona which eliminates LCM. This frequency range is high enough that toner particles do not respond to the individual AC cycles but rather to the average bias. In order to be effective against LCM an AC corona generating Vpp=1.6 kV is applied. While the DC offset is necessary for the cleaning function, it has no impact on the LCM function which depends mainly on the generation of AC corona. Finally, the brush speed is set from NVM to 500 RPM, up from the normal cleaner setting of 300 RPM, in order to increase photoreceptor abrasion somewhat.

In machine testing shows that LCM goal of 10× life extension in accelerated LCM tests using these set points. At 10K prints, at which point the test was suspended, Applicants found no trace of VOC induced LCM in either the image area or in the interdocument zone. Additionally the abrasive brush is clean at the end of the 10K print run and no cleaning failures are observed in halftones, ziptones and the Check TRC documents. Analysis of cleaning performance with high area coverage prints also showed no cleaning failures out to 150 kP (test suspended). No residual toner is observed on the brush at 150 kP. LCM testing has also shown that the 1000 grit SiC/epoxy coated brushes are still functional at 150K prints and beyond.

Set points for the abrasive brush in the cleaner housing can be determined from the brush electrical characteristics presented in FIGS. 15-17. The plots are obtained at 1.0 kHz and VDC=−350V at 300, 500 and 1000 RPM. FIG. 15 shows a plot of photoreceptor voltage vs. applied AC current. The charging characteristics are independent of brush speed. The photoreceptor voltage initially rises as the AC current increases but levels off at a photoreceptor voltage slightly less than the DC offset. FIG. 16 plots the plateau photoreceptor voltages obtained as a function of offset bias VDC. As shown in the figure, plateau voltages correspond very closely to offset bias. Taken together these data show that the abrasive brush is a nearly ideal contact charger even at iGen3 process speeds. This means that a photoreceptor voltage of about −300V enters the 1st charger, potentially improving charge uniformity on the photoreceptor at the first charge/recharge station. As a design rule it is best to operate farther right on the charging curve plateau where greater molecular degradation at the photoreceptor surface occurs, but not too far to the right that photoreceptor wear is unacceptably high. LCM life extension is related to degradation of the conductive/ionic species at high AC current.

FIG. 17 shows an I-V curve for the abrasive brush. The low slope part of the curve below 1.3 kVpp corresponds to the rising part of the curve in FIG. 15. Testing at these low AC current conditions shows little effectiveness against LCM. The high slope part of the curve in FIG. 17 corresponds to the plateau of FIG. 15, characterized by uniform charging and excess positive and negative charge deposition on the PR. AC brush testing in this regime (>1.3 kVpp) shows outstanding effectiveness against LCM, basically ≧10×. The design rules and effectiveness of this approach have also been demonstrated at 4 kHz.

As a photoreceptor cleaner/abrader, this concept may be able to bring the photoreceptor to a reproducible surface state so that transfer is no longer so sensitive to the nature of the film on the photoreceptor surface.

A fifth embodiment Cleaning Station as illustrated in FIG. 18 includes a cleaner brush with separate abrasive and electrically conductive areas for VOC induced LCM and cleaning. The abrasive brush is composed of separate areas of abrasive and electrically conductive fibers. A typical way of implementing this is to wind two separate pile fabric tapes onto the brush core, a conductive fiber tape—for corona generation or cleaning—and an abrasive tape.

EXAMPLE 5

Applicants have fabricated abrasive coated cleaner brushes in which the abrasive is patterned onto the brush surface in a spiral or barber shop pole pattern. The spiral region has a width ranging from 5 mm to 50 mm. The abrasive coating density in the coated area is maintained at the optimal 2-3 mg/cm2 range for effectiveness against LCM. A brush with as little as 33% surface area coverage of abrasive had an LCM effectiveness >10× in accelerated life testing. Since only a fraction of the surface is coated with abrasive, on average less energy is imparted to the residual additive on the photoreceptor surface which should delay the onset of filming or lessen its effects relative to the current fully coated abrasive brushes. Tailoring of the brush characteristics in the abrasive coated and non-coated areas can be done by selection of fiber denier, length, weave density or material composition.

The embodiments disclosed addressed several configurations of abrasive and conductive cleaner brushes that are useful in combating VOC induced LCM. A useful configuration is an epoxy/SiC abrasive coated cleaner brush which is biased to AC corona generating voltage. The key feature of this type of abrasive brush is that the fiber tips remain both conductive and abrasive. The brush tips are coated with a 10 micron thick epoxy binder containing 1000 grit SiC with a volume average particle size of ~5 microns. While the conduction mechanism of the epoxy coated fibers is not clear it is known that SiC particles are semi-conductive and they seem to provide the conductive pathway at the fiber tips. Imparting abrasive character to the brush obviously modulates the electrical characteristics of the cleaner brush. For example, coating the conductive fibers with epoxy increases the overall resistance of the brush and increases the voltage required to generate the AC corona. And normal process variations in brush coating result in variations in electrical properties which influences power supply design. From a design and function perspective, it would be desirable that the electrical (i.e., AC corona generation) and abrasive functions be separated. This would allow separate optimization of abrasion and corona generation. One implementation Applicants have employed is to wind two separate pile fabric tapes onto the brush core: (1) the usual conductive fiber tape for corona generation (or for that matter any other electrical function such as cleaning) and (2) abrasive fibers that can be an abrasive coating on either conductive or non-conductive fibers. Typically abrasive coated fibers can be made much finer than the fibers in commercially available abrasive filled fiber brushes. FIG. 18 schematically shows a rotary brush with the two different types of pile fabric tapes described above formed in a spiral pattern on the core. The relative areas of abrasive to non-abrasive fibers can be adjusted by relative widths of the two tapes.

FIG. 18 shows a schematic diagram of an abrasive brush coated 360 with abrasive and non-abrasive tapes. Because the overall abrasive loading is somewhat decreased in this arrangement it is necessary to check effectiveness against LCM. In order to do this we have fabricated a surrogate of the desired brush through a patterned spray coating of the abrasive material onto a nominal cleaner brush. Other methods of coating can be employed include dip coating or electrodepositing to fabricate the brush.

An IGEN3® cleaner brush was first masked with masking tape in a spiral pattern. The abrasive layer was then spray coated with abrasive as previously described. The masking tape was removed immediately after air drying of the abrasive coating and finally the whole brush was cured in an oven overnight at 150° F. to accelerate the curing of the epoxy binder. The pitch of the mask was adjusted to control the abrasive coated area coverage. Two area coverages were investigated −33% and 50% abrasive coated. The abrasive coating density within the coated region is comparable to those of fully coated brushes that are effective against LCM, that is 2-3 mg/cm2. Accelerated VOC induced LCM testing of both variants was done as previously described. The surrogate goal is 10× life extension in accelerated LCM testing. Accelerated life testing showed a >10× life extension with both brushes. Thus the spiral coated abrasive brushes are effective even down to 33% coverage. Spiral patterning is preferred as it maintains a constant drag against the photoreceptor and minimizes motion control issues.

Being able to reduce the area of the abrasive coating on the brush surface by a factor of 3 suggests that variations in overall brush resistivity and corona current would be comparably reduced, improving manufacturing tolerances and lessening power supply load variations.

Possible brush configurations and options include the following. The conductive (non-abrasive) fiber tape is biased with an AC corona generating bias. The latter may be DC offset or not depending on whether the brush is configured in the 2nd cleaner position or a separate 3rd brush system, respectively. The abrasive fiber tape may be abrasive coated onto conductive or non-conductive fibers as described above. The abrasive filler may be SiC, Al2O3, CeO2 and the like. We have found these fibers to be mechanically very robust—they remain intact to at least 100K cycles of the belt (test suspended). Alternatively the fibers of the non-abrasive tape may be abrasive filled (e.g. nylon filled with abrasive like Al2O3, SiC, CeO2, etc.). These fibers would typically be much thicker than abrasive coated fibers. Alternatively the fibers on the non-abrasive tape may be inherently abrasive, i.e. stiff nylon or polypropylene fibers. The two (or more) pile fabric tapes may be wound in a tightly wound configuration or loosely wound configuration resulting in no space or a finite space, respectively, between the different fabrics. Clearly it is possible to choose from many variations of relative pile height, relative areas of abrasive and non-abrasive fibers, weave densities and fiber diameters to optimize the brush performance, cost and manufacturability as desired.

While the present invention is described with reference to a preferred embodiment, particular embodiments and examples are intended to be illustrative and not limiting.

In recapitulation there has been provided a method for fabricating an abrading brush including providing brush includes a core defining a core length and having fibers extending outwardly therefrom; applying an epoxy binder on said fiber; and spray coating a layer of abrasive particles on the ends of said fibers, spray coating includes covering between 2 to 4 mm of the ends of said fibers, spray coating includes applying a conductive material on the ends of said fibers, spray coating includes selecting said abrasive particles from the group abrasive particles consisting of silicon carbide, aluminum oxide, cerium oxide, iron oxide, cubic boron nitride, garnet, silica, glass, zirconia. And said fibers are selected from the group fibers consisting of conductive and insulating synthetic fibers including styrene-acrylate, acrylic, nylon, polyethylene, polypropylene, polyester, polystyrene, rayon, polyethylethylketone (PEEK), polyvinylchloride, Teflon, carbon fiber and natural fibers including tampico, horsehair, palmetto, palmyra, And, said abrasive particles are between 0.2 microns and 15 microns in size.

There has also been provided several embodiments of a cleaning system utilizing an abrading brush for uniformly abrading the imaging surface to remove LCM therefrom.

It is, therefore, apparent that there has been provided in accordance with the present invention, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A cleaning system for cleaning an imaging surface moving in a process direction, comprising:

an abrading brush for uniformly abrading the imaging surface to remove laterally conductive deposits therefrom, said abrading brush includes a core defining a core length and having fibers extending outwardly therefrom, said fibers include abrasive particles permanently attached to the end or the entire length of said fibers; and a power supply for biasing said conductive fibers, said power supply applies an AC bias sufficient to generate corona in the brush-imaging surface nip at the ends of the conductive fibers.

2. The cleaning system of claim 1, wherein said abrading brush includes fibers without abrasive particles attached to the end of said fibers.

3. The cleaning system of claim 2, wherein said abrading brush includes a first region extending along the core having fibers including attached abrasive particles and a second region extending along the core having fibers without attached abrasive particles.

4. The cleaning system of claim 2, wherein said first region is a spiral region having a width ranging from 1 mm to 50 mm.

5. The cleaning system of claim 1, wherein said fibers selected from the group fibers consisting of conductive and insulating synthetic fibers including styrene-acrylate, acrylic, nylon, polyethylene, polypropylene, polyester, polystyrene, rayon, polyethylethylketone (PEEK), polyvinylchloride, carbon fiber and natural fibers including tampico, horsehair, palmetto, and palmyra.

6. The cleaning system of claim 1, wherein said fibers are between 1 denier per fiber and 30 denier per fiber in diameter and between 3 mm and 20 mm in length.

7. The cleaning system of claim 1, wherein said abrasive particles selected from the group abrasive particles consisting of silicon carbide, aluminum oxide, cerium oxide, iron oxide, cubic boron nitride, garnet, silica, glass, zirconia.

8. The cleaning system of claim 1, wherein said abrasive particles are between 0.2 microns and 15 microns in size.

9. The cleaning system of claim 1, wherein said fibers are conductive fibers.

10. The cleaning system of claim 1, wherein said primary cleaning device is in a housing separate from said abrading brush.

11. The cleaning system of claim 1, wherein said abrading brush is rotated between 100 rpm and 4000 rpm.

12. A cleaning system for cleaning an imaging surface moving in a process direction, comprising:

an abrading brush for uniformly abrading the imaging surface to remove laterally conductive deposits therefrom, said abrading brush includes a core defining a core length and having fibers extending outwardly therefrom, said fibers include abrasive particles permanently attached to the end or the entire length of said fibers; and a power supply for biasing said conductive fibers, said power supply applies an AC bias at a frequency between 100 Hz and 100 kHz and a voltage between 1 kV peak-peak and 5 kV peak-peak.

* * * * *